United States Patent [19]

Fujii et al.

[11] Patent Number: 4,554,769

[45] Date of Patent: Nov. 26, 1985

[54] ADHESIVE-BACKED TILE PANELS AND METHOD FOR INSTALLATION THEREOF

[75] Inventors: Morizumi Fujii, Nagoya; Hirofumi Kakimoto; Shinji Fujino, both of Fukuyama, all of Japan

[73] Assignee: Ina Seito Co., Ltd., Tokoname, Japan

[21] Appl. No.: 478,413

[22] Filed: Mar. 24, 1983

[51] Int. Cl.[4] ..... E04F 13/08

[52] U.S. Cl. ..... 52/173 R

[58] Field of Search ..... 52/384–390, 52/173 R; 428/40, 43

[56] References Cited

U.S. PATENT DOCUMENTS

| | | | |
|---|---|---|---|
| 1,852,696 | 4/1932 | Chaffee | 52/389 |
| 2,308,650 | 1/1943 | Desagnat | 52/388 |
| 2,678,896 | 5/1954 | Dratler | 52/384 |
| 3,962,504 | 6/1976 | Sherwin | 52/390 |
| 4,091,135 | 5/1978 | Tajima et al. | 428/40 |

*Primary Examiner*—James L. Ridgill, Jr.
*Attorney, Agent, or Firm*—Browdy and Neimark

[57] ABSTRACT

There is provided a novel adhesive-backed tile panel protected by a release sheet. The prefabricated tile panel comprises a substrate sheet composed of a core fabric and a heat-softening-adherent asphalt composition applied to the both surfaces of the fabric; an adhesive layer having convex and concave portions such as stripes of an adhesive not flowable but sticky at an ambient temperature; and tiles arranged regularly and secured to the asphalt composition layer of the substrate sheet. The convex portions and concave portions of the adhesive layer constitute the gaps through which air present between the tile panels and a substrate board can be purged upon installation of the tile panels. The tile panels can be installed readily on a substrate board having thereon horizontal indication means such as crosspieces by removing the release sheet, mounting the tile panels on the substrate board, and pressing the mounted tile panels to purge air present between the panels and the board through the gaps of the adhesive layer and to increase the effective adhesion areas of the adhesive layer. A unit substrate board having specified structures for assembling a preferred substrate board is also provided for installation of the tile panels.

11 Claims, 3 Drawing Figures

FIG. 2
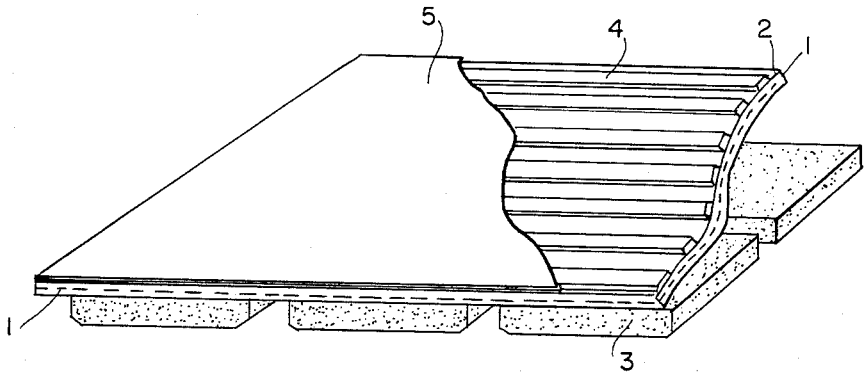
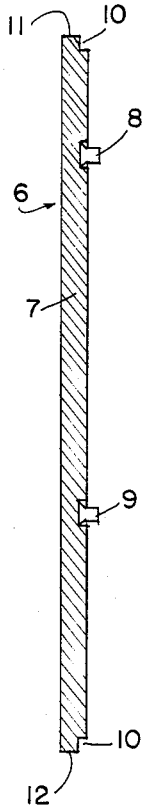
FIG. 3
FIG. 1
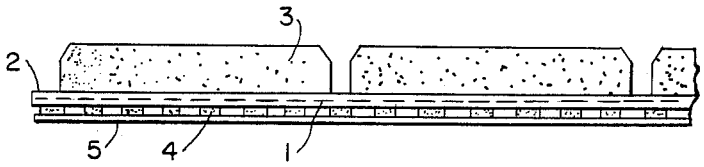

ADHESIVE-BACKED TILE PANELS AND METHOD FOR INSTALLATION THEREOF

BACKGROUND OF THE INVENTION

This invention relates to a novel adhesive-backed tile panel, and more particularly relates to a prefabricated tile panel comprising a substrate sheet composed of a core fabric coated with a heat-softening-adherent material, a multiplicity of tiles secured onto one surface of the substrate sheet, and an adhesive layer applied at specified intervals onto the other surface of the substrate sheet and protected by a release sheet. This invention also relates to a method for installing the prefabricated tile panels on a substrate board having horizontal lines or crosspieces for mounting the panel.

The advantages of ceramic tile walls and the like are well known especially for bathrooms, shower rooms, kitchens, etc. The setting of tiles at a construction site, however, requires a painstaking, time-consuming and skilled task. With the present high labor costs and the accelerated rate of construction, the conventional methods for installing ceramic tiles are extremely costly and time-consuming. The recent trend toward modular housing construction, wherein housing sections are factory built and joined together at the construction site, has further spotlighted the shortcomings of the traditional tile installation methods.

Thus, a variety of prefabricated tile panels including bonded tiles and having panel-securing means such as anchors have been proposed, for example, as disclosed in U.S. Pat. Nos. 3,646,180 and 3,817,012; the description being incorporated herein by reference to show the state of art and the foundation works for installing the prefabricated tile panels. Conventional prefabricated tile panels having bonded tiles are installed at a construction site by anchoring means or inorganic cement or rubber-adhesives.

The prefabricated tile panels having sticky bonding layers on all the back surfaces thereof are also known. Such panels, however, undergo partially floated or raised phenomena causing separation of installed panels, because upon installation it is difficult or even impossible to purge (i.e. exclude) air present at depressions on the surface of a substrate board or the back surface of the panel. Production of such conventional tile panels having sticky layers on the allover back surfaces thereof has troubles in that application of the sticky adhesive layer needs multiple complicated steps and broad working spaces and it is also difficult to apply a thick sticky layer uniformly. On the other hand, prefabricated tile panels to be installed by anchoring means are not always sound and may require rather complicated foundation works for installation.

Thus, the present inventors have conducted intensive research on prefabricated tile panels to accomplish the present invention and found that the above described problems or troubles can be solved or eliminated substantially by the prefabricated tile panel and the method for installing the tile panel of the present invention.

Accordingly, it is an object of the invention to provide a novel prefabricated tile panel to be readily installed on a substrate board.

It is another object of the invention to provide a novel method for installing the prefabricated tile panel on a substrate board rapidly and neatly by those unskilled in tiling techniques.

Other objects and advantages of the present invention will become apparent from the following description.

SUMMARY OF THE INVENTION

In accordance with the present invention, there is provided a prefablicated tile panel consisting essentially of a substrate sheet composed of a core fabric to both surfaces of which a heat-softening-adherent high molecular material was applied; an adhesive layer having convex and concave portions where an adhesive not flowable but sticky at an ambient temperature was applied to one surface of the adherent material of the substrate sheet to such a thickness and at such an interval that the panel can be bonded firmly to a substrate board and the air present between the back surface of the panel and a substrate board upon installation thereof can be purged through the gaps among the convex portions and concave portions of the adhesive layer, said adhesive layer being protected by a release sheet; and a multiplicity of tiles arranged regularly and secured by heating to the other surface of the adherent material of the substrate sheet.

There is also provided a method for installing the present prefabricated tile panels on a substrate board, which comprises setting the prefabricated tile panels from which the release sheets have been removed over a substrate board having means for indicating horizontal positions such as horizontal lines or crosspieces arranged at intervals of the vertical widths of the tile panels; mounting the adhesive layers of the prefabricated tile panels on the substrate board along the horizontal lines or crosspieces; pressing the top surfaces of the tile panels to purge air present between the adhesive layers of the tile panels and the surface of the substrate board through the gaps among the convex portions and concave portions of the adhesive layers which are communicated with the outsides of the panels as well as to increase effective adhesion areas of the convex portions of the adhesive layers by the pressing force applied thereto; and filling a joint compound into the joints of the tiles.

BRIEF DESCRIPTION OF THE DRAWINGS

FIG. 1 is a sectional view showing an embodiment of the prefabricated tile panels according to the present invention.

FIG. 2 is a partly broken perspective view showing an embodiment of the prefabricated tile panels.

FIG. 3 is a sectional view showing a preferred embodiment of unit substrate boards for installation of the tile panels according to the present invention.

DETAILED DESCRIPTION OF THE INVENTION

The heat-softening-adherent high molecular materials to be used in the present invention is exemplified by a polymer-modified asphalt composition such as rubber- or resin-modified asphalt compositions, which can be prepared by mixing a rubber material such as natural rubber, synthetic rubber (e.g., styrene-butadiene rubber, butyl rubber) or rubber latex, and/or a thermoplastic resin material such as polyolefin resins and vinyl acetate copolymer resin with natural asphalt and/or petroleum asphalt such as straight asphalt and semi-blown asphalt. As necessary, there can be further admixed auxiliary natural or synthetic resin materials such as natural rosin and aliphatic or aromatic petroleum resins as well as fillers such as carbon black, silica, calcium carbonate and clay.

The core fabric to be used is woven fabrics or nonwoven fabrics of synthetic fiber(s) such as polyester fiber, rayon fiber and polyvinyl alcohol fiber (Vinylon) and mixtures thereof. Nonwoven fabrics are preferred from the viewpoint of the dimension stability, etc. of the resulting tile panel.

The tile to be used may be ceramic tile, plastic tile and the like which are commercially available. Ceramic or porcelain tile is preferred from the viewpoint of resistance to fire, moisture, chemicals and the like.

The adhesive layer to be applied at a suitable interval to give the gaps which are communicated with the outsides of the resulting panel is composed essentially of an adhesive which is not flowable but sticky at an ambient temperature. The adhesive can be a heat-melting adhesive which comprises a major amount of a synthetic rubber such as styrene-butadiene rubber, butyl rubber, styrene-isoprene blockcopolymer and mixtures thereof and a minor amount of a tackifier such as polyisobutylene of a low polymerization degree, natural resins such as rosin, a modified terpene derivative and an aromatic petroleum resin. The adhesive can be further admixed with an antioxidant such as amine derivatives and phenol derivatives, a softening agent such as aromatic mineral oils, and asphalt.

The release sheet to be used is a conventional release film or release paper used for protecting an adhesive or sticking agent layer. The release sheet may have one or two sidewise perforation lines. In this case, the $\frac{1}{3}$, $\frac{1}{2}$ or $\frac{2}{3}$ portion of the release sheet is removed first from the adhesive-backed tile panel so that the panel can be readily handled by the hands and the installing position can be adjusted, the panel is mounted on the substrate board, and then the remaining release sheet is removed to install the panel on the board finally.

The prefabricated tile panel of the present invention can be produced in the following manner: with reference to FIGS. 1 and 2, the core fabric 1 is coated or impregnated with the polymer-modified asphalt composition. The heat-melting adhesive 4 is applied by melting it at the intervals defined above onto one surface of the substrate sheet composed of the core fabric coated with the asphalt composition 2. The adhesive layer is protected by the release sheet 5. A multiplicity of tiles 3 are bonded to the asphalt layer of the other surface of the substrate sheet by heating the system to a temperature lower than the softening point of the adhesive. In this case, the softening point of the asphalt composition is normally lower than that of the adhesive. Alternatively, in the process described above, the tiles can be bonded to the asphalt layer and then the adhesive can be applied to the other surface of the asphalt-coated substrate sheet. The latter process is useful when there is used an adhesive having a softening point lower than that of the asphalt composition. When a heat-melting adhesive is used, the production line can be simplified because a drying step of the adhesive and an exhaust system are not needed. Also, the convex portion of the adhesive layer can be formed readily and uniformly to a predetermined thickness.

The preferred specifications of the prefabricated tile panels of the present invention are given in the following. The dimension and weight of the present tile panels are normally such as can be readily handled by the hands. For example, the dimensions thereof will be not larger than those of rectangular 300 mm×900 mm or square 600 mm×600 mm, and the weight thereof will be about 6 kgs. or less. The typical panel containing 18 pieces of 100×100 mm tiles has the dimensions of 300×600 mm, and the total thickness thereof is about 7.5 mm wherein the thickness of the tile is about 5.5 mm, having a specific gravity of about 1.1. In general, the thickness of the convex portions of the adhesive layer is in the range of about 0.5 mm to about 2 mm. The thickness of the substrate sheet consisting of the core fabric coated with the asphalt composition is at least about 0.5 mm and normally in the range of about 0.5 mm to about 3 mm.

The adhesive is applied onto the back surface of the tile panel in an area coverage ratio of about 30% to about 70% and preferably about 40% to about 60%. The remaining area is comprised of concave portions having no or a small amount of the adhesive. The convex portions of the adhesive layer having a thickness of about 0.5 to about 3 mm and the concave portions on the back surface of the tile panel constitute gaps (grooves), through which air present between the panels and the substrate board can be readily purged upon installation of the panels. The shapes of the convex adhesive portions can be in the form of independent spots or continuous or discontinuous stripes, as far as the gaps formed among the convex and concave portions are communicated with the outsides of the tile panel. From the viewpoint of simplifying production steps and enhancing the effective adhesion area upon installation of the panels, it is generally preferred that the adhesive layer is in the form of stripes and especially of substantially straight stripes. The width of the convex stripe and the interval of the stripes are normally in the range of about 2 mm to about 8 mm and are typically about 5 mm, respectively. Incidentally, such stripes of the adhesive layer can be formed readily upon application of the adhesive, for example, by the use of a comb-edged tool or trowel. The stripes are normally provided in the longer side direction of the tile panel.

The substrate boards for installation of the present prefabricated tile panels can be readily assembled at a construction site, for example, on walls, studs or frames and the like by those unskilled. The substrate boards are preferably composed of flame retardant or self-extinguishing rigid boards such as asbestos slate boards having dimensions and weights which can be readily handled by the hands. The substrate board is characterized by having means for indicating horizontal positions such as horizontal lines, crosspieces or dotted protrusions arranged at an interval of the vertical width of the present tile panels so that the tile panels can be mounted on the substrate board along the horizontal means. Incidentally, the height of the horizontal crosspieces or dotted protrusions above the substrate board is normally smaller than the total thickness of the prefabricated tile panels, and the width of the crosspiece is the same as the gaps of tile joints of the panel or slightly smaller.

The horizontal line on the substrate board can be arranged in the form of grooves in the production step of the board or can be drawn readily on the substrate board as necessary. The horizontal crosspieces can be produced integratedly with the substrate boards, or can be formed by bonding the crosspieces on the surface or the horizontal grooves of the substrate board with a bonding agent. The bottom of the crosspiece 8, 9 can be made broader as illustrated in FIG. 3 so that it can be fixed to the board more stably.

A preferred embodiment of the substrate board for installation of the present tile panels is a unit substrate board illustrated by FIG. 3. In FIG. 3, the crosspieces 8, 9 are arranged horizontally on a slate board 6 (e.g., 600 mm in vertical length × 1800 mm in side length × 4 mm in thickness), the ratio of the interval between the top end 11 of the unit substrate and the upper crosspiece 8 to the interval between the two crosspieces 8, 9 to the interval between the lower crosspiece 9 and the bottom end 12 of the unit substrate 7 being in a ratio of 1:3:2. Thus, the bottom end of one unit substrate board and the top end of one other unit substrate board can be jointed to form the interval between the horizontal crosspieces for mounting the prefabricated tile panel. The crosspieces can also be produced integratedly on the substrate boards, or can be formed by fixing the crosspieces on the surface or horizontal grooves of the board with a bonding agent. Incidentally, thinner parts 10 (e.g., 3 mm in thickness × 10 mm in width) at the top and bottom edges or the four side edges of the substrate unit board can be provided for applying water-proof tapes to the connected parts formed by joining the unit substrate boards.

The present invention is further explained by way of Examples. It is to be noted, however, that the invention should not be restricted by the Example, and the modifications and variations are possible within the spirit and scope of the invention.

EXAMPLE

A core fabric 1 of polyester fiber (trade name Yunichika Spunbond 20707 WTA nonwoven fabric supplied by Yunichika K.K., Japan) was coated with a rubber-modified asphalt compound having a softening point of 89° C. On one surface of the resulting rubber-modified asphalt substrate sheet 2 having a thickness of 1.5 mm was coated a heat-melting butyl rubber-based adhesive 4 having a softening point of 108° C. by melting the adhesive to a thickness of about 1 mm in the form of straight stripes having a width of 5 mm and an interval of 5 mm. The adhesive layer 4 was protected with a release sheet 5. Then, a multiplicity of 98 mm squared tiles 3 (trade name Ina Ceramic Tile SP-120 85/ED supplied by Ina Seito Co., Ltd., Japan) were arranged regularly at tile-joint intervals of 2 mm. The other surface of the rubber-modified asphalt sheet 2 was placed on the back surfaces of the arranged tiles. They were maintained at 90° C. for 30 minutes. Thus, the surface of the asphalt substrate sheet was melted and the tiles 3 were bonded thereto to obtain a prefabricated tile panel of the present invention.

The release sheet 5 of the resulting tile panel was removed and then mounted on a glass plate. The surface of the tile panel was pressed by a hand roller 50 mm in width of a load of 5 kgs with two reciprocating motions at a velocity of 200 mm/minutes. Then, the effective adhesion area was determined through the glass plate. Although the area coverage of the adhesive on the tile panel was 50%, the effective adhesion area was increased to about 60% by the pressed deformation of the stripe-like adhesive layer.

COMPARATIVE EXAMPLE

A commercial prefabricated tile panel was coated with the same adhesive as used in Example on the all-over back surface and protected with a release sheet. It was subjected to the same adhesion test. The release sheet was removed from the tile panel. The tile panel was mounted on a glass plate and pressed in the same fashion as in Example. The effective adhesion area was determined through the glass plate and found to be about 30%, in spite of the fact that the area coverage of the adhesive was 100%.

Incidentally, the adhesive-backed tile panels should be clearly distinguished from adhesive-backed wall paper materials with respect to the difficulty in purging air upon installation thereof. Because the wall paper is very thin and flexible, there is not raised such a problem substantially.

What is claimed is:

1. A prefabricated title panel having side dimensions of about 300 mm or more which consists essentially of a substrate sheet composed of a core nonwoven fabric and a heat-softening-adherent polymer-modified asphalt material applied to both surfaces of the fabric, the thickness of the substrate sheet being about 0.5 to about 3 mm; an adhesive layer having convex and concave stripe portions with gaps therebetween comprising a heat-melting adhesive which is not flowable but sticky at an ambient temperature in the form of stripes adhered to one surface of the adherent material of the substrate sheet, said convex and concave stripe portions having such a thickness and being arranged at such an interval that the panel can be bonded firmly to a substrate board and air present between the back surface of the panel and a substrate board upon installation thereof can be purged through the gaps between the convex portions and the concave portions of the adhesive layer, an area coverage ratio of the convex stripes being about 30% to about 70%, the width and interval of the stripes being in the range of about 2 to about 8 mm, the convex stripes having a thickness of about 0.5 to about 3 mm; said adhesive layer being protected by a release sheet; and a multiplicity of ceramic or porcelain tiles arranged regularly and secured by heating to the other surface of the adherent material of the substrate sheet.

2. The tile panel according to claim 1, in which the release sheet has one or two perforation lines.

3. The tile panel according to claim 1, in which the heat-softening adherent material is a resin-modified asphalt composition.

4. The tile panel according to claim 3, in which the adherent material is a rubber-modified asphalt composition.

5. The tile panel according to claim 1, which has been installed on a substrate board by the steps comprising setting the tile panel from which the release sheet was removed over the substrate board; mounting the adhesive layer of the tile panel on the substrate board; pressing the top surface of the tile panel to purge air present between the adhesive layer of the tile panel and the surface of the substrate board through the gaps formed among the convex portions and concave portions of the adhesive layer, the gaps being communicated with the outsides of the tile panel, as well as to increase effective adhesive areas of the convex portions of the adhesive layer by the pressing force applied thereto; and filling a joint compound into the joints of the tiles.

6. The tile panel according to claim 5, in which the substrate board has thereon means for indicating horizontal positions of the tile panels, the means being arranged at an interval of the vertical width of the tile panel.

7. The tile panel according to claim 6, in which the means for indicating horizontal positions are horizontal crosspieces.

8. The tile panel according to claim 20, in which the means for indicating horizontal positions are horizontal dotted protrusions.

9. The tile panel according to claim 6, in which some portion of the release sheet has been removed first, the tile panel has been mounted on the substrate board and its portion adjusted, and then the remaining portion of the release sheet has been removed.

10. The tile panel according to claim 6, in which the substrate board is composed of a plurality of unit substrate boards, and each unit substrate board has two crosspieces arranged horizontally in the ratio of the interval between the top end of the unit substrate and the upper crosspiece to the interval between the two crosspieces to the interval between the lower crosspiece and the bottom end of the unit substrate board being in a ratio of 1:3:2.

11. The tile product according to claim 6, in which at least the top and bottom edges of the unit substrate board have been made thinner than the remainder of said unit substrate board to facilitate applying waterproof tapes.

* * * * *